US008034754B2

(12) United States Patent
Sullivan et al.

(10) Patent No.: US 8,034,754 B2
(45) **Date of Patent: *Oct. 11, 2011**

(54) FLUIDS FOR ENHANCED GEAR PROTECTION

(75) Inventors: William T. Sullivan, Brick, NJ (US); Halou Oumar-Mahamat, Princeton, NJ (US); Ellen Bernice Brandes, Bound Brook, NJ (US)

(73) Assignee: The Lubrizol Corporation, Wickliffe, OH (US)

( * ) Notice: Subject to any disclaimer, the term of this patent is extended or adjusted under 35 U.S.C. 154(b) by 1501 days.

This patent is subject to a terminal disclaimer.

(21) Appl. No.: 11/095,198

(22) Filed: Mar. 31, 2005

(65) Prior Publication Data

US 2006/0223720 A1 Oct. 5, 2006

(51) Int. Cl.
*C10M 137/04* (2006.01)
*C10M 141/10* (2006.01)

(52) U.S. Cl. ..... 508/433; 508/545; 508/591

(58) Field of Classification Search ..... 508/433, 508/421, 429, 564, 162, 545, 591
See application file for complete search history.

(56) References Cited

U.S. PATENT DOCUMENTS

| | | | | |
|---|---|---|---|---|
| 3,920,567 | A * | 11/1975 | Miller | 508/278 |
| 3,966,623 | A | 6/1976 | Krug et al. | |
| 5,225,093 | A * | 7/1993 | Campbell et al. | 508/287 |
| 5,328,619 | A | 7/1994 | Conary | |
| 5,342,531 | A | 8/1994 | Walters et al. | |
| 5,354,484 | A | 10/1994 | Schwind et al. | 252/32.5 |
| 5,484,542 | A * | 1/1996 | Cahoon et al. | 508/186 |
| 5,547,596 | A * | 8/1996 | Omiya | 508/188 |
| 5,552,068 | A | 9/1996 | Griffith | 508/436 |
| 5,622,923 | A | 4/1997 | Mathur et al. | |
| 5,756,429 | A | 5/1998 | Ichihashi | |
| 5,763,372 | A | 6/1998 | Tersigni et al. | |
| 5,767,044 | A | 6/1998 | Bigelow et al. | |
| 5,801,130 | A | 9/1998 | Francisco | 508/272 |
| 5,843,874 | A * | 12/1998 | Macpherson et al. | 508/470 |
| 5,866,519 | A * | 2/1999 | Watts et al. | 508/232 |
| 6,482,777 | B2 | 11/2002 | Cain | |
| 6,642,187 | B1 | 11/2003 | Schwind et al. | |
| 6,844,300 | B2 | 1/2005 | Milner et al. | 508/322 |
| 7,531,486 | B2 * | 5/2009 | Sullivan et al. | 508/433 |
| 2002/0160922 | A1 * | 10/2002 | Milner et al. | 508/419 |
| 2002/0165102 | A1 * | 11/2002 | Hata et al. | 508/192 |
| 2003/0096714 | A1 * | 5/2003 | Nakamura | 508/192 |
| 2003/0125219 | A1 * | 7/2003 | Tazaki et al. | 508/422 |
| 2003/0134758 | A1 * | 7/2003 | Bovington et al. | 508/525 |
| 2004/0005988 | A1 * | 1/2004 | Watanabe et al. | 508/192 |
| 2004/0192564 | A1 | 9/2004 | Balasubramaniam et al. | 508/436 |
| 2004/0235678 | A1 * | 11/2004 | Di Biase et al. | 508/154 |

FOREIGN PATENT DOCUMENTS

| | | |
|---|---|---|
| EP | 0 531 000 | 3/1993 |

(Continued)

*Primary Examiner* — Ellen McAvoy
*Assistant Examiner* — Taiwo Oladapo
(74) *Attorney, Agent, or Firm* — Christopher P. Demas; Teresan W. Gilbert

(57) ABSTRACT

The invention relates to lubricants which contain a phosphorus to nitrogen ratio of ≧1.0 and a sulfur content of >1.4 wt. %. The phosphorus contribution is primarily from an acid phosphate species and the sulfur content is primarily from an antiwear agent. This lubricant composition has been found to provide exceptional protection to new gears or "green gears", during the break-in phase.

15 Claims, 4 Drawing Sheets

FOREIGN PATENT DOCUMENTS

| | | | |
|---|---|---|---|
| EP | 391653 | B1 | 3/1994 |
| EP | 0391653 | B1 | 3/1994 |
| EP | 0 628 623 | | 5/1994 |
| EP | 0578435 | B1 | 10/1997 |
| EP | 0 848 052 | | 12/1997 |
| EP | 0450208 | B1 | 12/1999 |
| EP | 1 233 051 | | 8/2002 |
| EP | 1 422 287 | | 5/2004 |
| WO | 00/01790 | A1 | 1/2000 |

* cited by examiner

OEM X Axle Break-In Test
Effect of %S

FLUIDS FOR ENHANCED GEAR PROTECTION

FIELD OF THE INVENTION

The invention relates to the field of lubricating fluids.

BACKGROUND OF THE INVENTION

The number of SUVs and light trucks on the roads is currently increasing by about 15% per year. Part of the widespread popularity of these vehicles is their ability to operate under severe conditions, e.g., heavy towing of recreational equipment such as boats, or operating in rough and/or mountainous terrain. Owners expect to be able to use their vehicles for these purposes immediately, even in the first few hundred miles of the vehicle's life, which is characterized as the break-in period.

New gears contain surface imperfections that are inherent in the manufacturing process. During the break-in period, these imperfections are reduced through wear. The gears are worked which hardens and smooths the surface, thereby increasing the protection under slow speed and/or heavy load conditions where boundary conditions can exist. In the past, new gears were broken-in by the original equipment manufacturer (OEM). OEMs no longer do this, so, the break-in phase now occurs with the new vehicle owner. If the vehicle is placed under severe operating conditions, oil temperatures in the differential may increase well above 400° F. (about 200° C.), placing considerable strain on the new gears due to a thinning of the lubricant film that occurs on increasing temperature. This could result in damage to the differential in the form of heavy tooth spalling and breakage, bearing and seal failure, and ultimately, replacement of the entire differential.

Numerous efforts have been made to increase the temperature stability of lubricating oils. For instance, U.S. Pat. No. 5,354,484 teaches the use of at least one soluble tertiary aliphatic primary amine salt of a substituted phosphoric acid, and at least one soluble nitrogen- and boron-containing compound, in a lubricating composition said to be useful in gear applications requiring high thermal stability such as from about 160° C. with intermittent operation up to about 200° C.

U.S. Pat. No. 5,547,596 teaches a lubricant composition said to be useful for a limited slip differential of a car comprising a phosphate amine salt and borated ashless dispersant, the composition having a weight ratio of nitrogen to phosphorus ratio (N:P) of 0.5 or more, preferably 0.7 to 1.0, and a weight ratio of nitrogen to boron (N:B) of 4 to 10, preferably 6 to 9. Patentee states that if the ratio of N:B is more than 10, heat resistance deteriorates and sludge is liable to be generated.

U.S. Pat. No. 6,844,300 is directed to blending a base oil, a thermally stable phosphorus-containing anti-wear agent present in an amount sufficient to provide from 100 to 350 ppm phosphorus to the formulated gear and a metal-free sulfur-containing extreme-pressure agent present in an amount sufficient to provide at least 10,000 ppm sulfur to the formulated gear oil.

U.S. Application No. 2004/0192564 is directed to a fluid to control temperature increase under trailer towing break-in conditions without prior conditioning of new ("green") axles.

The fluid is a bimodal gear lubricant producing a gel permeation chromatogram having at least two peaks. The first peak is representative of a base oil having a low viscosity of about 2 cSt to about 8 cSt and the second is representative of a viscosity index improver (VII) having a viscosity in the range of about 600 cSt to about 45,000 cSt at 100° C.

See also U.S. Pat. Nos. 5,756,429; 5,801,130; EP 1422287 A1; and EP 531000 B1.

The present inventors have discovered a method of enhancing gear protection and a fluid composition suitable for practicing said method, which in embodiments is especially suitable for protecting new gears during break-in. In embodiments temperature increases in the oil lubricating the gears are lessened, even under harsh break-in conditions and/or fuel economy in a vehicle using said lubricating fluid is improved.

SUMMARY OF THE INVENTION

The invention is directed to a lubricant fluid comprising an antiwear component primarily comprising an acid phosphate (pentavalent phosphorus), at least one nitrogen-containing compound, and a sulfur-containing extreme pressure (EP) component, further characterized by having a phosphorus to nitrogen elemental weight ratio of greater than or equal to 1.0, and a sulfur content of greater than or equal to 1.5 wt. %.

In an embodiment the lubricating fluid is a fluid for driveline applications such as axle fluids.

The invention is also directed to a method of lubricating comprising adding the lubricant composition of the invention to a part or system to be lubricated, such as a gearbox, differential, or transmission.

It is an object of the invention to set forth lubricating fluid compositions, particularly suitable for driveline lubrication, said lubricating fluid providing exceptional protection particularly for new gear or "green gears" during the break-in phase and which in preferred embodiments provides reduced temperatures under harsh conditions and/or improved vehicle fuel economy.

These and other objects, features, and advantages will become apparent as reference is made to the following detailed description, figures, preferred embodiments, examples, and appended claims.

DETAILED DESCRIPTION

Figure 1:
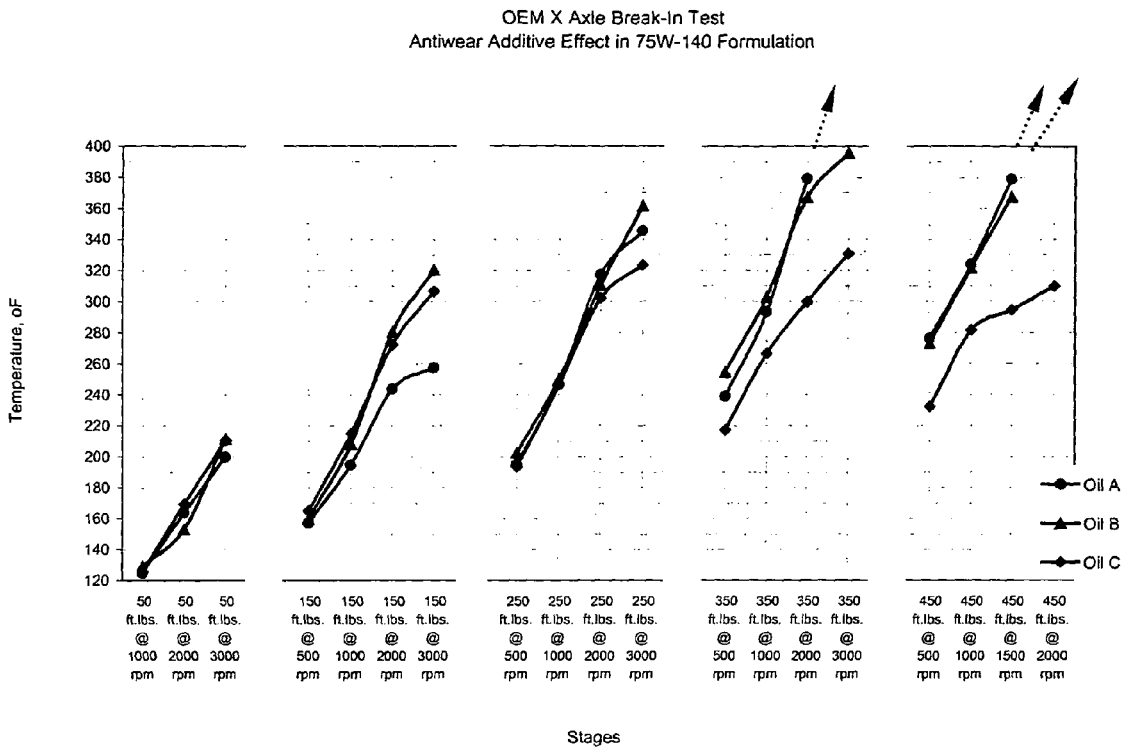
FIGS. 1 through 4 provide experimental results comparing compositions according to the present invention with other compositions in a green gear axle test.

According to the invention, a composition is provided comprising a basestock, an antiwear component primarily comprising an acid phosphate (pentavalent phosphorus), at least one nitrogen-containing antirust agent, and at least one sulfur-containing extreme pressure (EP) component, further characterized by having a phosphorus to nitrogen (P:N) weight ratio of greater than or equal to 1.0. In an embodiment, the composition further comprising other additives suitable for making a fully-formulated lubricant or other functional fluid. In an embodiment, the sulfur-containing extreme pressure component is provided in an amount sufficient to provide to a fully-formulated lubricant a final sulfur (S) level of greater than or equal to 1.5 wt. %. P, N, and S levels may be determined by elemental analysis, as would be apparent to one of ordinary skill in possession of the present disclosure.

Phosphorus-Containing Antiwear Additive

A critical feature of the present invention is the presence of an effective amount of a phosphorus-containing antiwear additive. The amount of phosphorus-containing antiwear additive will depend on several factors, such as the presence of other additives, particularly the amount of EP sulfur-containing additive, the elemental P:N weight ratio discussed further below, the basestock, the desired treat rate of the various additives in the basestock, and the like. An effective amount can be determined by one of ordinary skill in the art in possession of the present disclosure. While not critical to the characterization of the invention, in embodiments the phosphorus-containing antiwear additive will be present in the fluid in the amount of 5-20 wt %, with a level of P in the fluid of about 0.5-2.5 wt % and is generally dependent on the level and type of EP agent being employed. Weight percentages are based on the weight of the entire fluid composition.

Phosphorus-containing antiwear additives are per se known in the art, such as described in patents discussed in the Background, above, and also, by way of example, phosphonates as exemplified by U.S. Pat. Nos. 4,356,097 and 4,532,057; phosphites as exemplified in U.S. Pat. No. 4,778,610; and also pyrophosphates and other phosphorus-containing species.

A further critical aspect of the present invention is the presence of at least one mono- or dialkyl acid phosphate as the primary phosphorus-containing antiwear ingredient. The term "primary phosphorus-containing antiwear ingredient" in this invention means that it is present based on at least 50 wt %, preferably at least 55 wt %, more preferably at least 60 wt %, still more preferably at least 70 wt %, yet more preferably at least 80 wt %, yet still more preferably at least 90 wt %, even more preferably at least 95 wt % based on the weight of all phosphorus-containing species in the final composition.

Preferred mono- and/or dialkyl-acid phosphate antiwear additives include at least one species represented by the formula $R_1O(R_2O)P(O)OH$, where $R_1$ is hydrogen or hydrocarbyl and $R_2$ is hydrocarbyl. $R_1$ and $R_2$ may have the same or different hydrocarbyl groups.

Preferably the hydrocarbyl groups on $R_1$ (if present) and $R_2$ are independently selected from $C_1$-$C_{30}$ hydrocarbyls, preferably $C_3$-$C_{20}$ alkyl, alkenyl, or aryl-containing hydrocarbyls, which may be straight chain, branched or cyclic, and may also contain heteroatoms such as O, S, or N.

Suitable hydrocarbyl groups are alkyls of 1-40 carbon atoms, preferably 2-20 carbon atoms, more preferably 3-20 carbon atoms, alkenyls of 1-20 carbon atoms, cycloalkyls of 5-20 carbon atoms, aryls of 6-12 carbon atoms, alkaryls of 7-20 carbon atoms or aralkyls of 7-20 carbon atoms. Examples of suitable alkyl groups are methyl, ethyl, propyl, butyl, pentyl, hexyl, heptyl, octyl, nonyl, decyl, methyl-decyl or dimethyl-decyl. Examples of suitable alkenyl groups are ethenyl, propenyl, butenyl, pentenyl or hexenyl. Examples of suitable cycloalkyl groups are cyclohexyl or methylcyclohexyl. Examples of suitable cycloalkenyl groups are 1-, 2-, or 3-cyclohexenyl or 4-methyl-2-cyclohexenyl. Examples of suitable aryl groups are phenyl or diphenyl. Examples of suitable alkaryl groups are 4-methyl-phenyl (p-tolyl) or p-ethyl-phenyl. Examples of suitable aralkyl groups are benzyl or phenethyl.

It is possible to use a variety of acid phosphates, for example, one where R2 is an aryl group, and the other where R2 is an alkyl group like hexyl.

In still more preferred embodiments, the hydrocarbyl groups are selected from ethyl, iso-propyl, n-butyl, i-amyl, hexyl, 2-ethyl hexyl, n-octyl, nonyl, decyl, dodecyl, tridecyl, tetradecyl, hexadecyl, octadecyl, oleyl, linoleyl, linolenyl, phytol, myricyl, lauryl, myristyl, cetyl, stearyl, amyl phenol, nonyl phenol, methylcyclohexanol, alkylated napthol. The acid phosphate esters may be conveniently formed by reaction of the corresponding alcohols, in the proper stoichiometric amounts, with phosphoric acid, to make the desired mono- or dialkyl phosphate. The preferred acid phosphates for use in invention is selected from mono- and di-2-ethylhexyl acid phosphate, and mixtures thereof.

It should be pointed out that for the purposes of formulating a lubricating oil according to the invention it is preferred that the acid phosphate be oil-soluble.

Nitrogen-Containing Compounds

The nitrogen component will be provided by at least one nitrogen-containing compound from the following group of additives: rust inhibitors, dispersants, antioxidants, copper passivators, metal passivators, etc.

Nitrogen-Containing Rust Inhibitors

Rust inhibitors useful herein are any oil-soluble basic amine or combinations of amines. The amines can be primary, secondary, tertiary, acyclic or cyclic, mono or polyamines. They can also be heterocyclic. The amine-containing components can also contain other substituents, e.g. ether linkages or hydroxyl moieties. The preferred amines are generally aliphatic in nature. Some specific examples include: octylamine, decylamine, C10, C12, C14 and C16 tertiary alkyl primary amines (or combinations thereof), laurylamine, hexadecylamine, heptadecylamine, octadecylamine, decenylamine, dodecenylamine, palmitoylamine, oleylamine, linoleylamine, di-isoamylamine, di-octylamine, di-(2-ethylhexyl)amine, dilaurylamine, cyclohexylamine, 1,2-propylene amine, 1,3-propylenediamine, diethylene triamine, triethylene tetraamine, ethanolamine, triethanolamine, trioctylamine, pyridine, morpholine, 2-methylpiperazine, 1,2-bis(N-piperazinyl-ethane), 1,2-diamine, tetraminooctadecnene, triaminooctadecene, N-hexylaniline and the like. They may also be triazole or triazole derivatives, or salts thereof, e.g., 1,2,3-triazole, 1,2,4-triazole, and the like.

The most preferred amines for this invention to serve as rust inhibitors are oil-soluble aliphatic amines in which the aliphatic group is a tertiary alkyl group. Primene 81R and Primene JMT amines are commercially available amines (from RohMax) that fall into this category. In a particularly preferred embodiment, alkyl acid phosphate is added in excess to the Primene 81R and Primene JMT, so as to develop achieve the desired P:N ratio of greater than or equal to 1.0.

It should be noted that amines typically will combine with the acid phosphates to form salts, the resultant species effective as both an antirust and an antiwear agent. The salts of the phosphates and amines may be formed prior to addition to the final lubricant fluid, they may be formed in situ with a small amount of diluent (typically the final basestock) or they may be formed in situ after the acid phosphate and amine is added to the basestock. Various combinations are possible. The disclosure thus should be read in the nature of a recipe as regards the various additive described herein.

Amides, imides, and imidazolines, oxazolidones, and other related nitrogen-containing species can also be present. These species often serves as rust inhibitors, friction modifiers, and the like. Some examples of these include the reaction products of dodecenylsuccinic anhydride (DDSA) and tetraethylene pentamine, the reaction products of oleic acid and tetraethylene pentamine, the reaction products of diethylene triamine and DDSA, the reaction products of triethanolamine and nonanoic acid and the like.

Nitrogen-Containing Dispersants

Dispersants and/or cleanliness agents serve inter alia to keep sludge and varnish particles from coating on the gear surfaces. Numerous such agents are per se known in the art. There are no particular restrictions on the type to be used. They may be used singly or in combinations. Typical examples of nitrogen-containing dispersants include alkylsuccinimides, alkenylsuccinimides, boron-containing alkylsuccinimides, boron-containing alkenylsuccinimides, benzylamines compounds (Mannich bases), polybutenylamines, succinic acid ester compounds, and the like. The preferred embodiments are alkylsuccinimides, alkenylsuccinimides, and the boron-containing version of both of these. The especially preferred ashless dispersants for use in this invention are the products of reaction of a polyethylene polyamine, e.g. triethylene tetraamine pentaamine, with a hydrocarbon-substituted anhydride made by the reaction of a polyolefin, preferably having a molecular weight of about 700-1400 and especially 800-1200 with an unsaturated polycarboxylic acid or anhydride, e.g. maleic anhydride. Because of the low molecular weights it is not particularly important, for the purposes of the invention, whether the molecular weights are number average or weight average molecular weights. The ashless dispersants can be boronated to form ashless boron-containing dispersants using suitable boron-containing compounds: boron acids, boron oxides, boron esters, and amine or ammonium salts of boron acids. Otherwise, however, boron-containing species are not critical to the present invention and in embodiments there are no boron species present in the composition according to the invention or, in other embodiments, boron is only present in the aforementioned ashless dispersants.

Other Nitrogen-Containing Additives

Anti-oxidants containing aromatic nitrogen can also be employed and will contribute to the level of nitrogen. Antioxidants are used to protect the composition and reduce the decomposition by oxygen, especially at elevated temperatures. Typical antioxidants that contain nitrogen include secondary aromatic amine antioxidants. Specific examples include diphenylamines, alkylated diphenylamines, phenyl-alpha-napthylamines, and their derivatives. It is understood that the nitrogen in these species will contribute to the phosphorus to nitrogen mass ratio.

Another preferred but still optional ingredient that contains nitrogen is the class of additives known as metal passivators, and sometimes specfically as copper passivators. These comprise the class of compounds which include thiazoles, triazoles, and thiadizoles. Specific examples of the thiazoles and thiadiazoles include 2-mercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis-(hydrocarbylthio)-1,3,4-thiadiazoles, and 2,5-bis-(hydrocarbyldithio)-1,3,4-thiadiazoles. The preferred compounds are the 1,3,4 thiadiazoles, especially the 2-hydrocarbyldithio-5-mercapto-1,3,4-dithiadiazoles and the 2,5-bis(hydrocarbyldithio)-1,3,4-thiadazole. Several of these are commercially available, e.g. Afton Hitec 4313 and Mobilad C-610. Other suitable inhibitors of copper corrosion include imidazolines, described above, and the like.

All of the amine salts that can be formed from phosphorus-containing antiwear components with the above-mentioned amine-containing materials are also included in the scope of this invention. In preferred embodiments the antiwear and antirust component is selected from at least one tertiary primary amine salts of 2-ethylhexyl acid phosphates.

One who is skilled in the art will recognize that there are other additives, e.g. friction modifiers, chromophores, demulsifiers, viscosity index improvers, etc. that may contribute to the P:N ratio and these are also to be included.

P:N Ratio

Another critical aspect of the present invention is the mass ratio of phosphorus to nitrogen (P:N). It has been found by the present invention that the fluid composition must be further characterized by the weight ratio of phosphorus to nitrogen greater than or equal to about 1.0 ($\geqq$1.0). In preferred embodiments the P:N ratio will be 1.2 and more preferably 1.5. The term "about 1.0" should be taken to include the number 0.95 and above, including, for instance, the number 0.98. In embodiments, the P:N ratio is greater than or equal to 1.00, which would not be taken to include 0.98.

While not particularly critical to the invention, typically an upper limit on the P:N ratio in a fully-formulated lubricating oil would be about 2.5. The vast majority of both elements phosphorus and nitrogen is typically contributed by additives and thus the contribution of P and N from the basestock is typically negligible in the elemental analysis.

Sulfur-Containing Extreme Pressure Component

Sulfur in the lubricant composition preferably comes primarily (e.g., greater than 50 wt. %) from the extreme pressure (EP) component, which is a metal-free sulfur containing species. It will be recognized that sulfur is also a species present to a large extent in certain basestocks. It is sufficient that the final sulfur content of the fully-formulated lubricant be greater than or equal to 1.5 wt. %, based on the entire weight of the composition. Accordingly, the amount of the sulfur containing EP component to add will be an amount sufficient to provide the necessary sulfur content in the final lubricant fluid composition.

Preferably, the sulfur-containing extreme pressure agents contain about 20-65% sulfur by weight. No particular restriction is put on the sulfur-containing additive in the form of the extreme pressure agent, which is blended into the base oil. The sulfur additives that are typically used in gear oils can be employed in this invention. Sulfur-containing components that may be used include sulfurized olefins, dialkyl polysulfides, diarylpolysulfides, sulfurized fats and oils, sulfurized fatty acid esters, trithiones, sulfurized oligomers of C2-C8 monoolefins, thiophosphoric acid compounds, sulfurized terpenes, thiocarbamate compounds, thiocarbonate compounds, sulfoxides, and thiol sulfinates. The preferable components are sulfinurized oligomers of C2-C8 monoolefins, olefin sulfides and dialkyl and diaryl polysulfides.

The more preferred extreme pressure agents are sulfurized olefins (see e.g. U.S. Pat. Nos. 2,995,569; 3,673,090, 3,703,504, 3,796,661; 4,119,549; 4,119,550; 4,147,640; 4,240,958; 4,344,854, 4,472,306; 4,711,736; 5,135,670; 5,338,468) and dihydrocarbyl polysulfides (see e.g. U.S. Pat. Nos. 2,237,625; 2,237,627; 2,527,948; 2,695,316; 3,022,351; 3,308,166; 3,392,201; 4,564,709).

Preferred dihydrocarbyl polysulfides are those prepared via a high pressure sulfurization. These may be prepared, for instance, by the reaction of sulfur, an olefin, and hydrogen sulfide, which may be provided in situ or added from an external source. The preferred method for the purpose of providing an extreme pressure agent for use in the fluid of the invention involves generating the hydrogen sulfide in situ. In a more preferred embodiment, hydrogen sulfide is formed in the reactor from sodium hydrogen sulfide and consumed within the reactor.

In a more preferred embodiment, the high pressure sulfurized olefin is prepared by reacting an olefin, preferably isobutylene, with molten sulfur in predetermined quantities in the presence of aqueous sodium hydrogen sulfide under high pressure conditions. Commercially available high pressure sulfurized isobutylene (HPSIB) include Mobilad C-170 and Mobilad C-175. In a more preferred embodiment, the level of sulfur in this HPSIB will be from about 44 wt % to about 55 wt %.

Besides the EP additive, sulfur contributions may also come from, as mentioned, the base oil itself, or it can come from a diluent oil if used to facilitate mixing of the various ingredients prior to preparing the final fluid composition comprising the basestock and additives. It can also come from other additive components, like antiwear agents (e.g. mono- and dithiophosphorus acids esters), antioxidants (e.g. sulfurized alkyl phenols), metal passivators, (e.g. thiadiazole and thiazole derivatives), and possibly also from sulfurized dispersants. All of these sulfur sources will contribute to the final sulfur content, which as previously mentioned should be greater than 1.5 wt % in the final lubricant composition.

Other Ingredients

The lubricating composition can also include other additives that do not fall into any of the categories mentioned above, for example, pour point depressants, VI improvers, detergents, defoamants, etc. without interfering with this invention. Also, those skilled in the art will realize that non-nitrogen containing anti-oxidants, dispersants, rust inhibitors, and corrosion passivators can also be added. They just will not contribute to the P:N ratio.

Base Oils

The additives set forth above are added to one or more base oils to make a lubricating fluid according to the invention.

Fluids that can meet the criteria of base oil for lubricant and functional fluids are varied. They may fall into any of the well-known American Petroleum Institute (API) categories of Group I through Group V. The API defines Group I stocks as solvent-refined mineral oils. Group I stocks contain the least saturates and sulfur and have the lowest viscosity indices. Group I defines the bottom tier of lubricant performance. Group II and III stocks are high viscosity index and very high viscosity index base stocks, respectively. The Group III oils contain fewer unsaturates and sulfur than the Group II oils. With regard to certain characteristics, both Group II and Group III oils perform better than Group I oils, particularly in the area of thermal and oxidative stability.

Group IV stocks consist of polyalphaolefins (PAOs), which are produced via the catalytic oligomerization of linear alpha-olefins (LAOs), particularly LAOs selected from C5-C14 alphaolefins, preferably from 1-hexene to 1-tetradecene, more preferably from 1-octene to 1-dodecene, and mixtures thereof, with 1-decene being the preferred material, although oligomers of lower olefins such as ethylene and propylene, oligomers of ethylene/butene-1 and isobutylene/butene-1, and oligomers of ethylene with other higher olefins, as described in U.S. Pat. No. 4,956,122 and the patents referred to therein, and the like may also be used. PAOs offer superior volatility, thermal stability, and pour point characteristics to those base oils in Group I, II, and III.

Group V includes all the other base stocks not included in Groups I through IV. Group V base stocks includes the important group of lubricants based on or derived from esters. It also includes alkylated aromatics, polyinternal olefins (PIOs), polyalkylene glycols (PAGs), etc.

One of the great benefits of the present invention is that it is applicable to base oils fitting into any of the above five categories, API Groups I to V, as well as other materials, such as described below. As used herein, whenever the terminology "Group . . . " (followed by one or more of Roman Numerals I through V) is used, it refers to the API classification scheme set forth above.

It will be recognized that commercially-available hydrocarbon fluids also typically contain small amounts of heteroatom-containing species (e.g., oxygen, sulfur, nitrogen, and the like), typically on the order of less than 1 wt. %, preferably less than 100 ppm.

EXAMPLES

The following examples are meant to illustrate the present invention and provide a comparison with other methods and the products produced therefrom. Numerous modifications and variations are possible and it is to be understood that within the scope of the appended claims, the invention may be practiced otherwise than as specifically described herein.

Lubricating compositions are prepared in accordance with this invention. As shown in the experiments below, the resulting fluids were found to provide sump temperature reduction when green hypoid axles are subjected to heavy loads in a Green Axle Break-in Test. New OEM axles were used in a T-bar type test configuration similar to ASTM D6121-01 (the L-37 Gear Durability Test), with the exception that the power source is from a 250 hp electric motor and constant heat removal is provided by air fans directed at the axle carrier. Dynamometers were used to vary the torque and an electric motor was employed to control the speeds. Each axle tested was used as is, with no initial break-in. The test consists of a series of increasing rpm stages at a constant torque. When the maximum rpm has been reached, the torque is increased.

Temperature is constantly recorded in each stage. Oil performance is defined by the temperature of each stage at equilibrium. Sump temperatures and efficiencies were measured at each stage. The axle was run through 19 stages of varying torques and rpms. Table 1 provides a set of possible conditions under which such a test can be run.

TABLE 1

| Stage # | Torque, ft-lb | Speed, rpm |
|---|---|---|
| 1 | 50 | 1000 |
| 2 | 50 | 2000 |
| 3 | 50 | 3000 |
| 4 | 150 | 500 |
| 5 | 150 | 1000 |
| 6 | 150 | 2000 |
| 7 | 150 | 3000 |
| 8 | 250 | 500 |
| 9 | 250 | 1000 |
| 10 | 250 | 2000 |
| 11 | 250 | 3000 |
| 12 | 350 | 500 |
| 13 | 350 | 1000 |
| 14 | 350 | 2000 |
| 15 | 350 | 3000 |
| 16 | 450 | 500 |
| 17 | 450 | 1000 |
| 18 | 450 | 1500 |
| 19 | 450 | 2000 |

The test is designed to simulate SUV usage under a variety of conditions, including towing conditions seen at the higher torque stages, e.g. 350 and 450 ft-lb. With inadequate lubricant protection, sump temperatures may exceed 400° F. (about 200° C.) in this test (as in real life). These varying speeds and torques can be used to mimic the overloading of new gears. The present inventors believe, therefore, that the Green Axle Break-in Test is a good way to measure whether a lubricant can adequately control temperature and protect green gears.

A variety of candidate oils were tested alongside of a variety of commercial factory fill fluids in the Axle Break-in Test. Axles from two different Original Equipment Manufacturers (OEMs) were used, referred to herein as OEM X and Y, both major North American SUV manufacturers. Results are shown in Tables 2-4 below.

The results illustrate the following with respect to green axle break-in: (1) the importance of using an acid phosphate as the primary antiwear additive; (2) the need for a P/N ratio of at least 1.0; (3) the need for the presence of greater than or equal to 1.5 wt. % sulfur in the finished oil; and (4) the desirable features of certain basestock compositions.

In Table 2, three oils are presented: Oil A, B and C. Oil A is OEM Y's factory fill oil, which is an SAE Grade 75W-140 multigrade fluid. Oil B is an oil prepared for comparison, along with Oil A, to Oil C, with regard to antiwear chemistry.

Oil C in Table 2 is a fluid prepared according to the present invention. All three oils have the same level of sulfur in oil, similar basestocks compositions, similar P/N ratios and nearly identical 100° C. viscosities. However, all three of these fluids have different antiwear additive compositions. Oil A is a collection of monothiophosphate, dithioposphate, acid phosphate, and pyrophosphate, where the acid phosphate contributes less than 20-25 weight % of the total weight of phosphorus in the finished oil. Oil B is primarily a mixture of alkyl acid phosphate and alkyl hydrogen phosphite antiwear additives, where the acid phosphate contributes about 40% of the total weight of phosphorus. The phosphorus in Oil C, however, is predominantly from an acid phosphate ester antiwear additive.

FIG. 1 shows the results of the Axle Break-in test for these three oils. It is clear from this illustration that Oil C, formulated according to the invention, exhibits lower temperatures in the higher torques stages—simulating towing heavy loads—than comparative Oils A and B, formulated using conventional compositions. Oil C, with the acid phosphate antiwear chemistry according to the present invention, performs the best in the Green Axle Break-in Test shown in FIG. 1. There are no stages in which the temperature exceeds 400° F. for Oil C, while both Oil B and Oil A, have multiple stages in which the temperature exceeds 400° F. (about 200° C.), as shown by the arrows indicating off-scale temperatures in the stages of the test with 350 ft lbs and 450 ft lbs.

In Table 3, the importance of the P/N ratio is illustrated. Here, Oil D, a commercial factory fill oil for OEM X, is contrasted with Oil E, an oil formulated according to the invention. Both oils have the same viscosity grade and approximately the same level of sulfur in the finished oil. Both possess the same antiwear additive chemistry but in differing amounts relative to the amount of nitrogen in the composition. The P:N ratio of Oil D is much lower than that of Oil E. As shown in Table 3, Oil D has multiple stages where the temperature exceeded 400° F. (about 200° C.) when compared to Oil E. With OEM X's axle, there were five stages where the temperature was over 400° F. and one stage with OEM Y's axle. Oil E, the oil formulated according to the present invention, had no stages where the temperature rose above 400° F.

Table 4 shows a series of compositions whose results reveal the effect the level of sulfur on break-in. Sulfur is primarily contributed by the alkyl polysulfide or sulfurized olefin in current commercially available gear oils. In Table 4, Oils F and G were blended to compare with the candidate oils, Oil H and I. All four of these oils used the same additive package, so the SIB is identical as is the P/N ratio and the antiwear agent. However, the treat rate of the additive package is different, so the level of sulfur differs. Oils F and G have a 1.4% sulfur level and Oils H and I have a 2.2% level of sulfur. Moreover, Oils F and H differ from Oils G and I by their 100° C. viscosities. While the same base stock components were used for all four oils (PAO/ester), the 26 cSt oils have differing amounts of the heavier viscosity PAO relative to the 11.5 cSt fluids.

Figure 2:
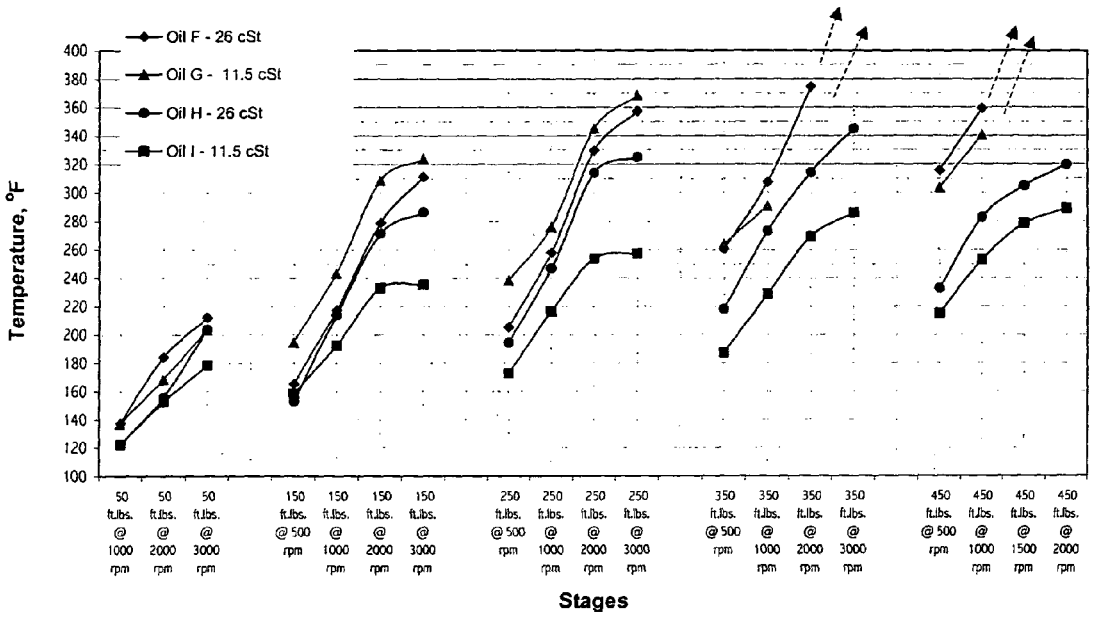

Neither candidate Oil H nor Oil I had any stages in which the temperature shot above 400° F. However, the comparison oils, Oils F and G had 3 and 4, respectively. This is a very interesting result in that Oil I is much lower in viscosity than Oil F, but it had significantly better performance. FIG. 2 is a graphical illustration of the results from this break-in test. It clearly shows that at the higher torque stages (350, 450 ft-lb), Oils H and I have much lower temperatures at each rpm relative to Oils F and G, which are over 400° F. for several different speeds at the higher torques.

Figure 3:
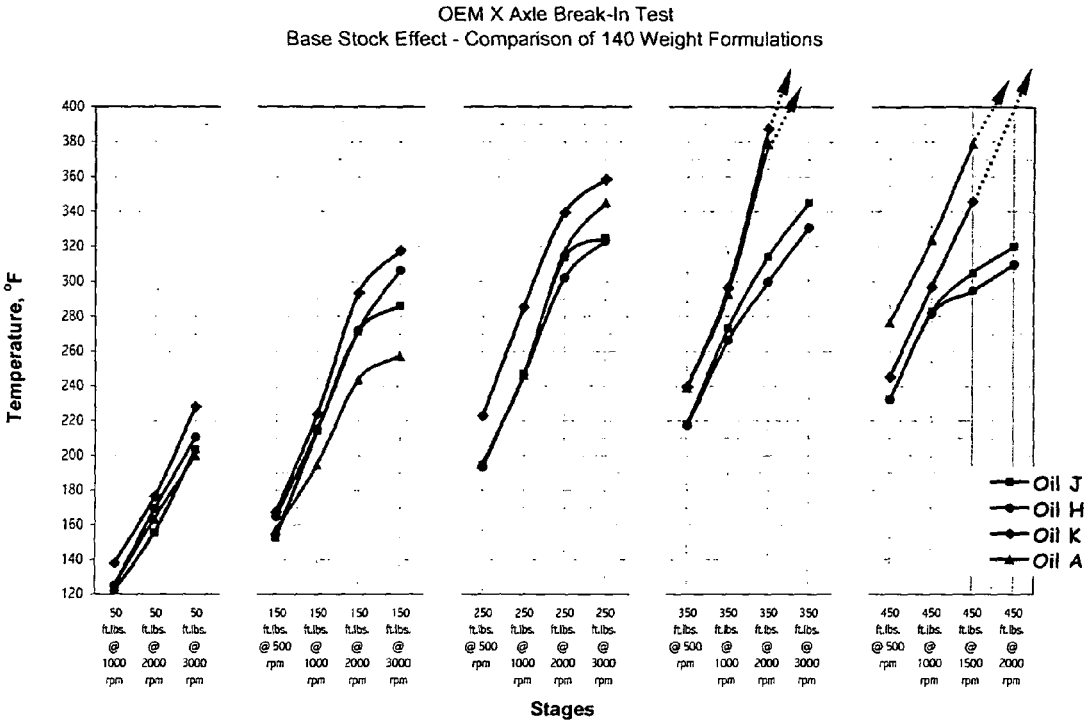

In FIG. 3, the effect of the base stock is examined. Oil A was described earlier. Oils H, J, and K are all oils described by this invention, i.e. acid phosphate antiwear additive, with wt % S≧1.5, and P/N ratio of ≧1.0. Oil H and J are both synthetic oils using a combination of monoester and PAOs. All three of these oils are 75W-140s. Oil K is an 85W-140 oil. It has a Group I base stock composition. Interestingly, it performed better in the Axle Break-in Test than the full synthetic commercial factory fill oil, Oil A. The two synthetic oils described by this invention (Oil H and J) perform better than the Group I-based oil (Oil K), implying that base stock composition is also an important feature.

TABLE 2

Contrasting Antiwear Agent Composition in Axle Break-in Test with OEM X Axle

| Oil Code | Description | Base Stock | KV 100, cSt | Visc. Grade | P/N | % S in Finished Oil | Antiwear Chemistry | # of Stages Where Temp was >400° F. |
|---|---|---|---|---|---|---|---|---|
| Oil A | Commercial Factory Fill for OEM Y | Ester, PAO | 25.1 | 75W-140 | 1.3 | 2.2 | Monothiophosphate Dithiophosphate Pyrophosphate Acid phosphate | 2 |
| Oil B | Example | Ester, PAO | 25 | 75W-140 | 1.2 | 2.2 | Acid phosphate Phosphite | 1 |
| Oil C | Example | Ester, PAO | 25.3 | 75W-140 | 1.5 | 2.2 | Acid phosphate | 0 |

TABLE 3

Effect of P/N Ratio on Temperatures in Axle Break-in Test

| Oil Code | Description | KV 100, cSt | Visc. Grade | P/N | % S in Finished Oil | Antiwear Agent Chemistry | # of Stages Where Temp. was >400° F. with OEM X Axle | # of Stages Where Temp. was >400° F. with OEM Y Axle |
|---|---|---|---|---|---|---|---|---|
| Oil D | Commercial Factory Fill for OEM X | 17.5 | 75W-90 | 0.63 | 2.1 | Acid Phosphate | 5 | 1 |
| Oil E | Example | 17.8 | 75W-90 | 1.5 | 2.3 | Acid Phosphate | 0 | 0 |

TABLE 4

Effect of Sulfur Level on Temperatures in Axle Break-in Test with OEM X Axle

| Oil Code | Description | Base Stock* | KV 100, cSt | Visc. Grade | P/N | % S in Finished Oil | Antiwear Agent Chemistry | # of Stages Where Temp. was >400° F. with OEM Y Axle |
|---|---|---|---|---|---|---|---|---|
| Oil F | Comparison example | PAO, Ester | 26 | 75W-140 | 1.5 | 1.4 | Acid phosphate | 3 |
| Oil G | Comparison example | PAO, Ester | 11.5 | 70W | 1.5 | 1.4 | " | 4 |
| Oil H | Example | PAO, Ester | 26 | 75W-140 | 1.5 | 2.2 | " | 0 |
| Oil I | Example | PAO, Ester | 11.5 | 70W | 1.5 | 2.2 | " | 0 |

*Base stock compositions are identical.

Figure 4:
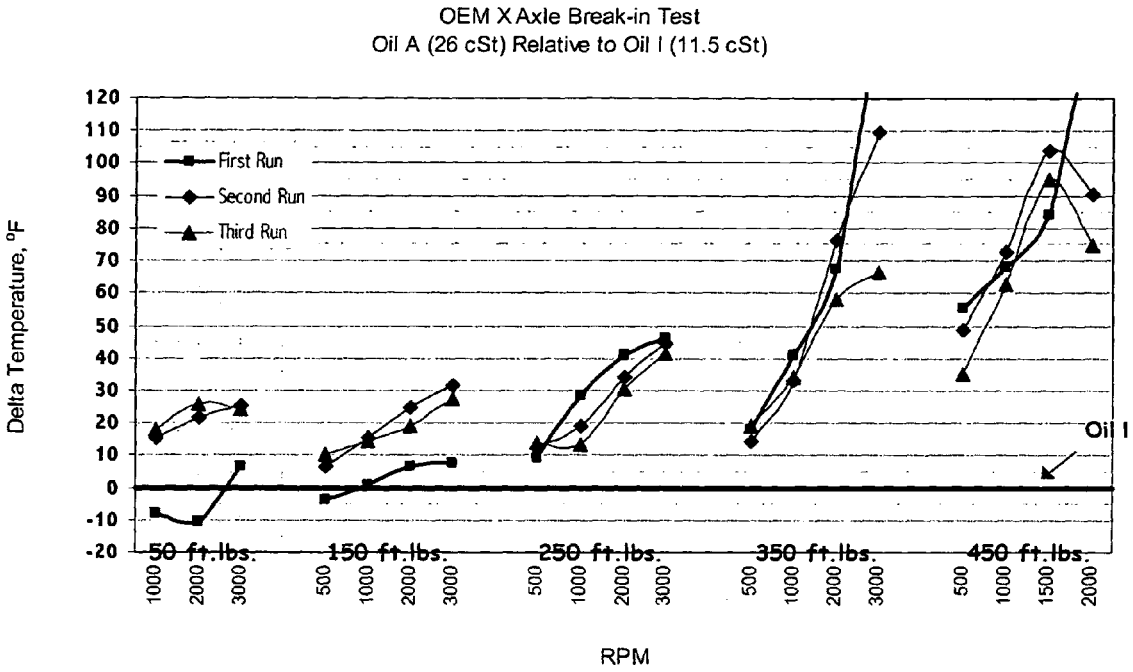

FIG. 4 shows the most dramatic results. Here, the results for Oil A, the 26 cSt commercial factory fill fluid, are plotted relative to those of Oil I, an 11.5 cSt oil that is described by this invention. The temperatures seen at each of the 19 stages, with the exception of three of the early stages, are higher, sometimes significantly higher, than the 11.5 cSt oil, indicating far better protection for the green axle during the break-in phase for the break-in phase of candidate Oil I.

In an embodiment, a lubricant composition according to the invention provides protection to gears during the break-in phase, even under extreme towing conditions. In a Green Axle Test with OEM gears, the lubricant compositions according to the present invention maintained lower temperatures under a variety of speeds and torques as compared to commercial factory fill fluids, as shown in the examples below. Lower fluid temperatures help to protect seals and other driveline components.

The benefit of this invention is the protection of green gears for SUVs and trucks under the very harsh conditions that new owners often subject their vehicles. This results in fewer new axles being broken, which would mean a substantial savings to OEMs. In addition, the lower temperatures provided by the ExxonMobil candidate oils should result in increased lifetime of the oil.

Finally, EMCC's 75W-90 and 70W candidate oils appear to offer better protection than the commercial fluids, even the 75W-140. Therefore, this invention will allow one to retrieve efficiency benefits from directionally lower churning losses using lower viscosity SAE fluids, while still maintaining the required protection in the differential.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The invention has been described above with reference to numerous embodiments and specific examples. Preferred embodiments include a lubricant fluid comprising a basestock, preferably at least one basestock selected from API Group I, II, III, IV, and V, and further comprising a phosphorus-containing antiwear component, a nitrogen-containing compound, and a sulfur-containing extreme pressure component, said composition characterized by having an phosphorus to nitrogen weight ratio of greater than or equal to about 1.0, based on the weight of the entire composition, wherein at least 50 wt % of said antiwear component is provided by at least one acid phosphate having the formula $R_1O(R_2O)P(O)OH$, where $R_1$ is hydrogen or hydrocarbyl and $R_2$ is hydrocarbyl. The invention may also be characterized as the contact product of the above recited materials, recognizing that the composition is set forth by way of a recipe or product by process description. The invention may be further characterized by at least one of the following limitations, which may be combined as would be recognized as appropriate by one of ordinary skill in the art in possession of the present disclosure: wherein at least 60 wt % of said antiwear component is provided by said at least one acid phosphate; wherein at least 75 wt % of said antiwear component is provided by said at least one acid phosphate; wherein at least 95 wt % of said antiwear component is provided by said at least one acid phosphate; wherein $R_1$ is hydrogen or a hydrocarbyl group are selected from ethyl, iso-propyl, n-butyl, i-amyl, hexyl, 2-ethyl hexyl, n-octyl, nonyl, decyl, dodecyl, tridecyl, tetradecyl, hexadecyl, octadecyl, oleyl, linoleyl, linolenyl, phytol, myricyl, lauryl, myristyl, cetyl, stearyl, amyl phenol, nonyl phenol, methylcyclohexanol, and alkylated napthol; wherein $R_2$ is a hydrocarbyl group are selected from ethyl, iso-propyl, n-butyl, i-amyl, hexyl, 2-ethyl hexyl, n-octyl, nonyl, decyl, dodecyl, tridecyl, tetradecyl, hexadecyl, octadecyl, oleyl, linoleyl, linolenyl, phytol, myricyl, lauryl, myristyl, cetyl, stearyl, amyl phenol, nonyl phenol, methylcyclohexanol, and alkylated napthol; wherein $R_1$ is an alkyl group and $R_2$ is an aryl group; wherein the at least one acid phosphate is selected from mono- and di-2-ethylhexyl acid phosphate, and mixtures thereof; wherein said nitrogen-containing compound is selected from oil-soluble aliphatic amines in which the aliphatic group is a tertiary alkyl group. The invention may also be characterized as a lubricant fluid, especially a lubricant fluid for a gearbox, transmission, or differential, comprising inter alia an antiwear component, the improvement comprising the fluid having an elemental phosphorus to nitrogen weight ratio of greater than or equal to about 1.0, based on the weight of the entire composition, and wherein at least 50 wt % of the antiwear component is provided by at least one acid phosphate having the formula $R_1O(R_2O)P(O)OH$, where $R_1$ is hydrogen or hydrocarbyl and $R_2$ is hydrocarbyl or in an embodiment wherein at least 50 wt % of the phosphorus (based on the weight of the entire composition) is provided by at least one acid phosphate having the formula $R_1O(R_2O)P(O)OH$, where $R_1$ is hydrogen or hydrocarbyl and $R_2$ is hydrocarbyl. A preferred embodiment of the invention is also a lubricating composition comprising a basestock, a phosphorus-containing antiwear component, a nitrogen-containing antirust agent, and a sulfur-containing extreme pressure component, said lubricating composition characterized by having an elemental phosphorus to nitrogen weight ratio of greater than or equal to 1.0, based on the weight of the entire lubricating composition, wherein at least 50 wt. % of said antiwear component is provided by at least one acid phosphate having the formula $R_1O(R_2O)P(O)OH$, where $R_1$ is hydrogen or hydrocarbyl and $R_2$ is hydrocarbyl, and further characterized by a sulfur content of greater than or equal to 1.5 wt. %. The composition may also be characterized, in preferred embodiment, as comprising a basestock consists essentially of a mixture of at least one API Group IV and at least one API Group V basestocks, and also an even more preferred embodiment wherein the basestock is a mixture of at least one PAO and at least one monobasic acid ester, and also an embodiment wherein the basestock is a mixture of at least two PAOs and at least one monobasic acid ester; and embodiments wherein the basestock consists essentially of at least one API Group I basestock; wherein said basestock consists essentially of at least one API Group II basestock; wherein said basestock consists essentially of at least one API Group III basestock. The invention is also directed to a method for reducing operating temperatures in a lubricating fluid comprising using the fluid of the invention, a method of fuel economy of a vehicle comprising using the fluid of the invention, a method of lubricating a gearbox, transmission, or differential comprising using the lubricating fluid of the invention, and it is also directed to any driveline component lubricated by the fluid composition according to the invention, especially driveline components selected from gearbox, differential, tranmission, and combinations thereof, and also to a machine comprising said driveline components, particularly a vehicle such as a car, truck, or farm equipment. However, many variations will suggest themselves to those skilled in this art in light of the above detailed description.

What is claimed is:

1. A method of lubricating a driveline component during a break-in phase comprising adding a lubricating fluid to said driveline component, wherein the driveline component is an axle gear, and wherein the lubricating fluid is a lubricating composition comprising a basestock, a phosphorus-containing antiwear component, a nitrogen-containing compound selected from oil-soluble aliphatic amines in which the aliphatic group is a tertiary group, and a sulfur-containing extreme pressure component, said lubricating composition characterized by having an elemental phosphorus to nitrogen weight ratio of greater than or equal to 1.0, based on the weight of the entire lubricating composition, wherein at least 50 wt. % of said antiwear component is provided by at least one acid phosphate having the formula $R_1O(R_2O)P(O)OH$, where $R_1$ is hydrogen or hydrocarbyl and $R_2$ is hydrocarbyl, further characterized by a sulfur content of greater than or equal to 1.5 wt. %, and wherein the hydrocarbyl groups of $R_1$ and $R_2$ are branched $C_1$-$C_{30}$ hydrocarbyls.

2. The method according to claim 1, wherein at least 60 wt. % of said antiwear component is provided by said at least one acid phosphate.

3. The method according to claim 1, wherein at least 75 wt. % of said antiwear component is provided by said at least one acid phosphate.

4. The method according to claim 1, wherein at least 95 wt. % of said antiwear component is provided by said at least one acid phosphate.

5. The method according to claim 1, wherein at least one acid phosphate is selected from mono- and di-2-ethylhexyl acid phosphate, and mixtures thereof.

6. The method according to claim 1, wherein said basestock is selected from API Group I through V and mixtures thereof.

7. The method according to claim 6, wherein said basestock consists essentially of a mixture of API Group IV and API Group V basestocks.

8. The method according to claim 6, wherein said basestock consists essentially of a mixture of at least one PAO and at least one ester.

9. The method according to claim 8, wherein said basestock consists essentially of at least two PAOs.

10. The method according to claim 8, wherein said at least one ester is a monobasic acid ester.

11. The method according to claim 6, wherein said basestock consists essentially of at least one API Group I basestock.

12. The method according to claim 6, wherein said basestock consists essentially of at least one API Group II basestock.

13. The method according to claim 6, wherein said basestock consists essentially of at least one API Group III basestock.

14. A method for reducing operating temperatures in a driveline component during a break-in phase comprising adding a lubricating fluid to said driveline component, wherein the driveline component is an axle gear, and wherein the lubricating fluid is a lubricating composition comprising a basestock, a phosphorus-containing antiwear component, a nitrogen-containing compound selected from oil-soluble aliphatic amines in which the aliphatic group is a tertiary group, and a sulfur-containing extreme pressure component, said lubricating composition characterized by having an elemental phosphorus to nitrogen weight ratio of greater than or equal to 1.0, based on the weight of the entire lubricating composition, wherein at least 50 wt. % of said antiwear component is provided by at least one acid phosphate having the formula $R_1O(R_2O)P(O)OH$, where $R_1$ is hydrogen or hydrocarbyl and $R_2$ is hydrocarbyl, further characterized by a sulfur content of greater than or equal to 1.5 wt. %, and wherein the hydrocarbyl groups of $R_1$ and $R_2$ are branched $C_1$-$C_{30}$ hydrocarbyls.

15. A method for increasing fuel economy during a break-in phase in a vehicle comprising a driveline component, said method comprising adding a lubricating fluid to a driveline component of said vehicle wherein the driveline component is an axle gear, and wherein the lubricating fluid is a lubricating composition comprising a basestock, a phosphorus-containing antiwear component, a nitrogen-containing compound selected from oil-soluble aliphatic amines in which the aliphatic group is a tertiary group, and a sulfur-containing extreme pressure component, said lubricating composition characterized by having an elemental phosphorus to nitrogen weight ratio of greater than or equal to 1.0, based on the weight of the entire lubricating composition, wherein at least 50 wt. % of said antiwear component is provided by at least one acid phosphate having the formula $R_1O(R_2O)P(O)OH$, where $R_1$ is hydrogen or hydrocarbyl and $R_2$ is hydrocarbyl, further characterized by a sulfur content of greater than or equal to 1.5 wt. %, and wherein the hydrocarbyl groups of $R_1$ and $R_2$ are branched $C_1$-$C_{30}$ hydrocarbyls.

* * * * *